United States Patent [19]

Swan

[11] 3,977,594

[45] Aug. 31, 1976

[54] POLYGONAL CARTON

[76] Inventor: Walter B. Swan, 8713 S. 87th Terrace, Justice, Ill. 60458

[22] Filed: Aug. 4, 1975

[21] Appl. No.: 601,593

[52] U.S. Cl. ..... 229/39 R; 229/41 C
[51] Int. Cl.[2] ..... B65D 5/10; B65D 5/36
[58] Field of Search ..... 229/41 C, 41 B, 39 R, 229/39 B, 38, 67

[56] References Cited

UNITED STATES PATENTS

| | | | |
|---|---|---|---|
| 2,483,464 | 10/1949 | Johnson | 229/7 R X |
| 2,565,182 | 8/1951 | Maxom | 229/17 R |
| 3,000,496 | 9/1961 | Larson | 229/41 C X |
| 3,526,352 | 9/1970 | Swett | 229/41 C X |
| 3,901,431 | 8/1975 | Carlson | 229/41 C X |

FOREIGN PATENTS OR APPLICATIONS

| | | | |
|---|---|---|---|
| 500,292 | 3/1954 | Canada | 229/39 B |
| 1,559,856 | 2/1969 | France | 229/39 R |
| 1,201,192 | 8/1970 | United Kingdom | 229/39 R |

*Primary Examiner*—Davis T. Moorhead
*Attorney, Agent, or Firm*—Thomas R. Vigil; Donald L. Dennison

[57] ABSTRACT

A polygonal carton constructed from a unitary blank of stiff but foldable material and having a strong, weight supporting bottom. The carton has a plurality of side panels and a concave bottom. The bottom is formed from a plurality of triangularly shaped bottom panels equal in number to the side panels. Each bottom panel is hingedly connected to one of the side panels and inclines upwardly from the bottom edge of the side panel to the center of the carton bottom. A foldable web is hingedly connected to and between the abuting side edges of adjacent bottom panels. Each web is folded into a reinforcing rib above or below the carton bottom. The ribs hold the panels in place as and when a load is placed on the bottom and the load is supported, at least in part, by the locking and bearing engagement between abuting side edges of adjacent bottom panels.

20 Claims, 17 Drawing Figures

POLYGONAL CARTON

BACKGROUND OF THE INVENTION

1. Field of the Invention.

The present invention relates to polygonal cartons and more specifically to a polygonal carton made from a unitary blank of stiff but foldable material and having a strong weight supporting bottom. Although the carton of the present invention can have any number of sides, i.e., three or more, the preferred embodiments of the invention have an even number of sides and in particular six or more sides, i.e., cartons approaching a cylindrical, drum or bushel-basket shape. Polygonal cartons of this type are presently classified in class 229 subclasses 37, 39, 41 and related subclasses.

2. Description of the Prior Art.

Heretofore various polygonal cartons made from a unitary paperboard blank have been proposed. Examples of such previously proposed polygonal cartons are disclosed in the following patents.

U.S. Pat. Nos.

1,909,649
2,000,210
2,517,552
2,761,611
3,071,308
3,559,871
3,526,352
3,700,161
3,768,720

Typically these cartons are made of paperboard which has only a limited weight supporting capacity. As a result there is a limit on the weight supporting capacity of these cartons and heretofore polygonal cartons with six or more sides have not been widely used in place of drums or cylindrical containers currently in use for storing fluid materials having significant weight.

Some attempts have been made, however, to improve the construction and strength of end closures for polygonal cartons and U.S. Pat. Nos. 3,526,352 and 3,700,161 referred to above disclose several improved end closures.

As will be described in detail hereinafter the polygonal carton of the present invention provides a further improvement, namely, a polygonal carton having a bottom construction which has significant weight supporting capacity.

SUMMARY OF THE INVENTION

According to the invention there is provided a polygonal carton having a plurality of side panels and a weight supporting bottom formed by a plurality of bottom panels equal in number to said side panels, each said bottom panel being hingedly connected to one of said side panels, being inclined upwardly from the bottom edge of the side panel to which it is connected so as to form an acute angle therewith, and having two side edges which abut adjacent side edges of adjacent bottom panels whereby a load which is placed on said bottom and which urges said bottom panels downwardly will be supported, at least in part, by the locking and bearing engagement between said abuting side edges of said bottom panels.

Also according to the invention there is provided a unitary carton blank made of stiff but foldable material and including a plurality of parallel spaced score lines dividing said blank into a plurality of generally rectangular sideforming panels and said blank having a plurality of generally triangular bottom-forming panels equal in number to said rectangular panels, each triangular panel being hingedly connected to one of said rectangular panels.

DESCRIPTION OF THE PREFERRED EMBODIMENTS

Figure 1:
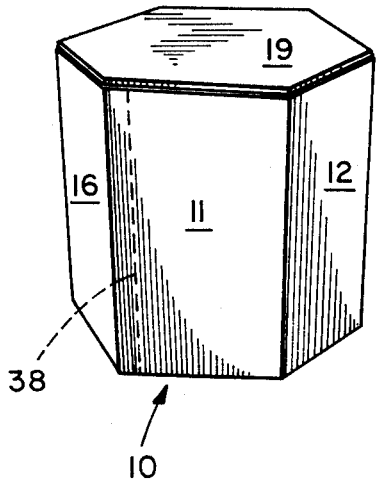
FIG. 1 is an elevational perspective view of a six sided carton constructed according to the teachings of the present invention.
Figure 6:
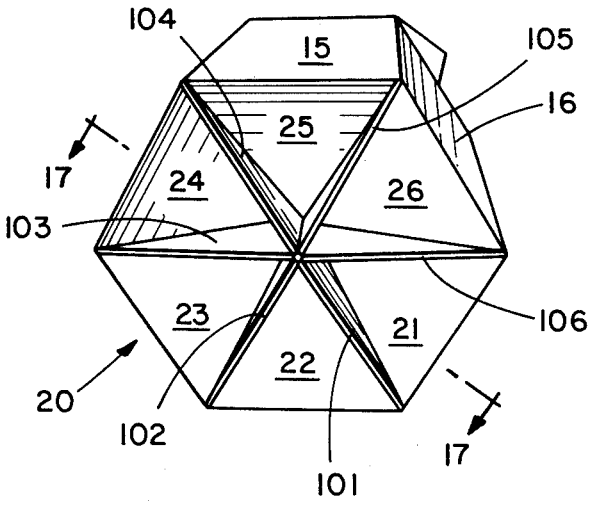
FIG. 6 is a bottom perspective view of the carton shown in FIG. 4 and shows the bottom reinforcing ribs of the carton.

Referring now to the drawings in greater detail, a six sided carton is illustrated in FIG. 1 and generally identified by reference numeral 10. The carton 10 has six generally rectangular side wall panels 11–16, a top end closure 18 including a hexagonal top flap 19 and a bottom 20 (FIG. 6) including six generally triangular bottom wall panels 21–26 (FIG. 6).

Figure 2:
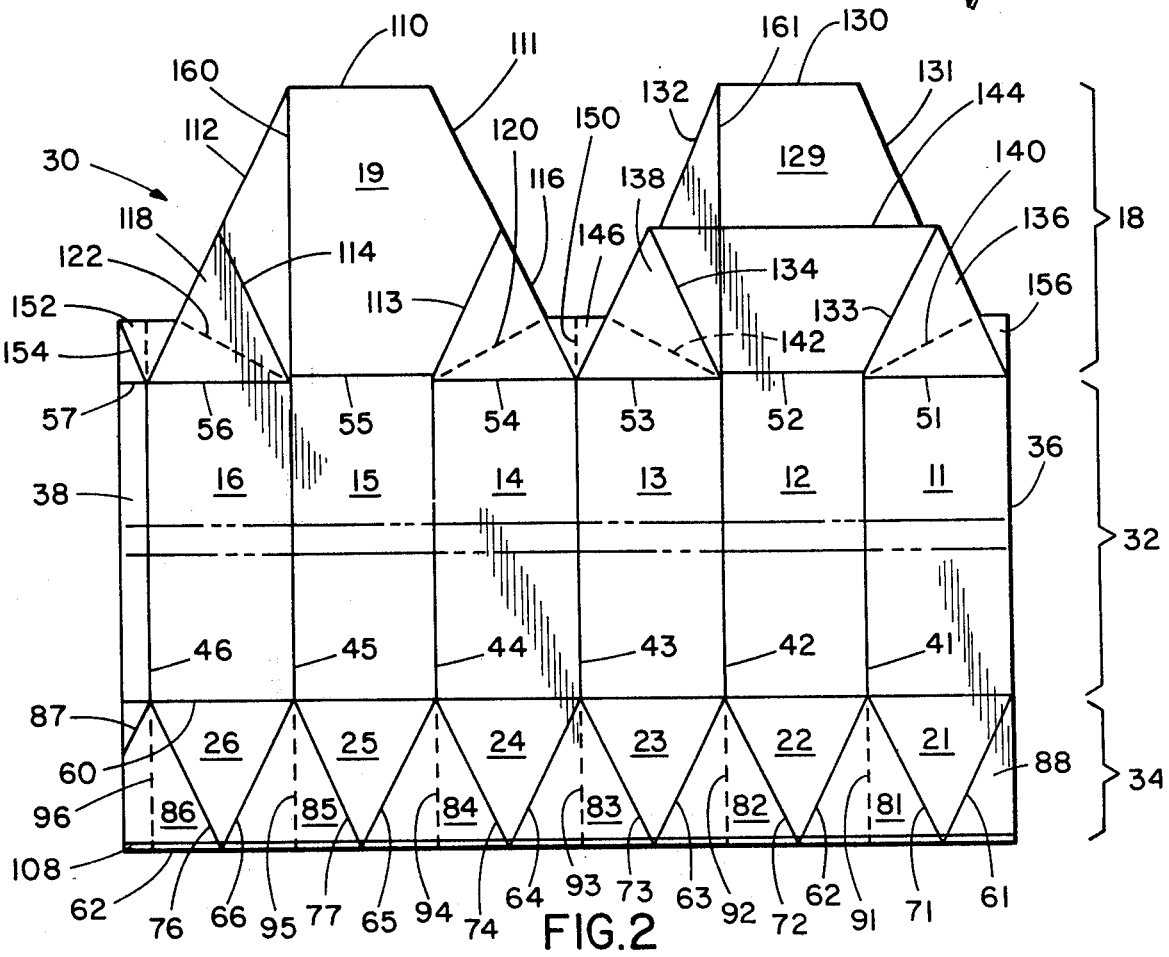
FIG. 2 is a plan view of the paperboard blank from which the carton of FIG. 1 is formed.

The carton 10 is formed from a blank 30 which is made of stiff but foldable material and which is shown in FIG. 2. Suitable materials from which the blank 30 can be formed include double faced corrugated paperboard, chip board, solid fiber board and plastic corrugated board.

The blank 30 has three portions, a top portion comprising the top end closure assembly 18 of the carton, a middle portion 32 comprising the six side panels 11–16, and a bottom portion 34 including the bottom panels 21–26. One side edge 36 of the blank 30 is a free edge and a flap 38, commonly referred to as the "manufacturers joint", extends along the opposite side edge of the blank 30.

For the purpose of this description the blank 30 now will be described with reference to the orientation of the blank 30 shown in the drawings it being understood that the blank 30 can and will have different orientations.

The center portion 32 has six parallel spaced vertical fold or score lines 41–46 dividing the center portion into the six side panels 11–16 and the flap 38. A series of horizontal score or fold lines 51–56 separate the center portion 32 from the top end closure assembly 18 and a continuous horizontal score or fold line 60 separates the center portion 32 from the bottom portion 34.

Referring now to the bottom portion 34, each of the bottom panels 21–26 is defined between the fold line 60 and a pair of angular fold lines each of which extends from a corner of the adjacent side panels 11–16 to a vertex or meeting point of the lines at a bottom edge 62 of the blank 30. The pair of fold lines for bottom panel 21 are designated by reference numerals 61 and 71, for bottom panel 22 by reference numerals 62 and 72, etc. When the blank 30 is folded into the carton 10, these reference numerals 61–66 and 71–76 identify two side edges of respective bottom panels 21–26.

A foldable web 81–85 of blank material is situated between adjacent bottom panels 81–82, 82–83, etc. A web portion 86 is situated at the left hand side of the blank 30 and extends into the flap 38 which has a fold or score line 87 therein so that the web portion can overlap and form a complete web with a web portion 88 at the right hand side of the blank 30 when the blank 30 is folded into the carton 10.

The webs 81–85 and web portion 86 are generally triangular and have a perforated fold line 91–96 therein extending from fold line 60 to free edge 62. Each fold line 91–96 is in line with one of the fold lines 41–46 and bisects the angle between adjacent fold lines 71, 62; 72, 63; etc., thereby dividing each web into two rib sections which, when blank 30 is folded into carton 10, are folded onto each other to form a double ply reinforcing rib. These ribs are shown in FIG. 6 and identified by reference numerals 101–106.

If desired, the blank 30 can have a strip 108 of double faced adhesive adhered to a margin of blank 30 adjacent the bottom free edge 62. The strip 108 extends across each web 81-85 and web portions 86 and 88 in a position where the portions of each strip on each web 81–85 and web portion 86 will be folded onto itself when the blank 30 is folded into carton 10 thereby to secure the rib sections together. Prior to folding of blank 30, strip 108 has a peelable cover strip to permit stocking of a plurality of the blanks 30.

As shown in FIG. 2 the top end closure assembly 18 includes the top panel 19 hingedly connected by fold line 55 to side panel 15. The top panel has an outer free edge 110 parallel spaced to fold line 55 and two free edges 111, 112 which extend angularly from free edge 110 to fold lines 113 and 114 which define edges of the flap 19 after the blank 30 is folded into the carton 10. The edges 110-112 and the fold lines 55, 113 and 114 define the hexagonal shape of the flap 19.

Also the free edges 111 and 112 extend respectively across portions of two foldable structures 116 and 118 each of which has a perforated fold line 120 or 122 therein. Each of the foldable structures 116 and 118 is hingedly connected between one side edge 113, 114 of the flap 19 and an adjacent side panel 14, 16 at fold line 54, 56. As shown the fold lines 54 and 56 are spaced slightly below fold line 55 to provide space for the foldable structures 116 and 118 when they are folded under flap 19.

When the blank 30 is folded into carton 10 side panel 12 will be opposite side panel 15 and the top end closure assembly 18 further includes a second flap 129 hingedly connected at fold line 52 to side panel 12 and foldable to a position underneath flap 19. Like flap 19, flap 129 has an outer free edge 130 parallel spaced from fold line 52, free edges 131 and 132, edge forming fold lines 133 and 134, and foldable structures 136 and 138 each having a perforated fold line 140, 142 therein and being hingedly connected between an edge 133, 134 of flap 129 and an adjacent panel 51, 53. The flap 129 also has a fold line 144 parallel spaced approximately midway between fold line 52 and outer free edge 130. Fold line 144 facilitates folding of the flap 129 under flap 19. Additionally edges 131 and 132 extend to fold line 144 and to a point inwardly of the end of edge forming fold lines 133 and 134. This offsetting of edges 131 and 132 from the end of edges 133 and 134 also facilitates folding of flap 129 under flap 19. Additionally fold lines 51 and 53 are lower than fold line 52 to facilitate folding of the foldable structures 136 and 138 under flap 129.

A triangular web 146 is hingedly connected at fold lines between foldable structures 116 and 138 and has a perforated fold line 150. A web portion 152 is hingedly connected at a fold line to foldable structure 118 and extends into flap 38 which has a fold line 154 therein for forming the web portion 152 into a web similar to web 146 when the blank 30 is folded over into carton 10 and web portion 152 overlaps and is adhered to a web portion 156 hingedly connected at a fold line to foldable structure 136.

Each of the flaps 19 and 129 has a vertical fold line 160, 161 therein which are in line respectively with fold lines 45 and 41. These fold lines 160 and 161 permit folding of the left hand side of blank 30, i.e., side panel 16, onto side panel 15 and the right hand side of the blank 30, i.e., side panels 11 and 12, onto side panels 13 and 14. With the blank 30 thus folded, flap 38 is juxtaposed the margin adjacent side edge 36 to facilitate machine handling and securing (such as with an adhesive) of the manufacturers joint 38.

Figure 3:
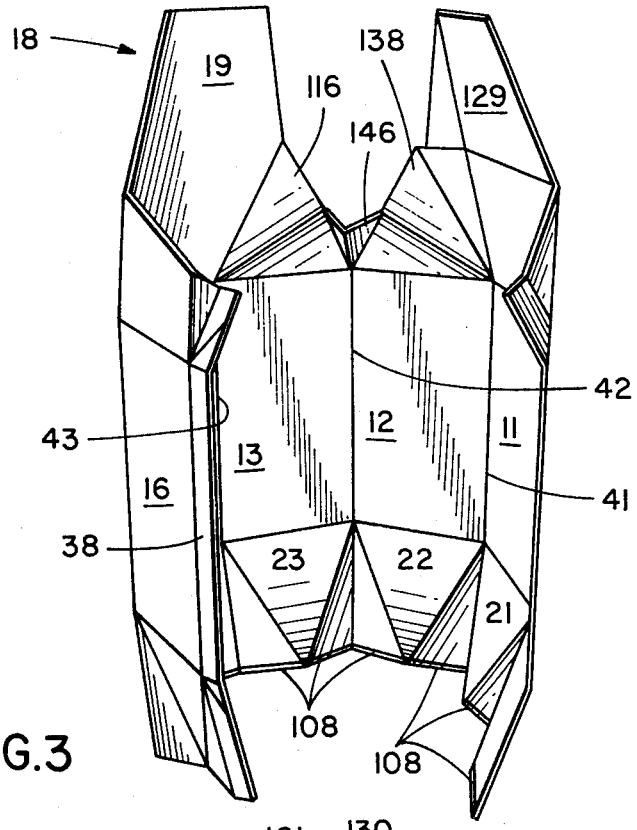
FIG. 3 is an elevational perspective view of the blank shown in FIG. 2 partially folded into the carton shown in FIG. 3.

In forming the blank 30 into the carton 10, preferably the manufacturers joint 38 is first made secure to the margin adjacent side edge 36, such as in a machine as briefly outlined above. Next the bottom 20 is formed and, if the adhesive strip 108 is utilized, the peelable cover thereof is first removed. The initial folding of the various panels toward there desired position is shown in FIG. 3 where, for the sake of clarity, the manufacturers joint 38 is shown in an unsecured position and apart from side edge 36. As shown the blank 30 is folded at the fold lines 41–46 to fold the side panels 11–16 into place, the bottom panels 21–26 are folded upwardly and the webs 81–86 are folded about the fold lines 91–96. In the embodiment shown in FIGS. 1–8 and 17 the webs 81–86 are folded into the reinforcing ribs 101-106 beneath the bottom panels 21–26 and into a star formation as best shown in FIG. 6. However, as illustrated in the embodiment shown in FIG. 10 the reinforcing ribs can be folded above the bottom panels 21–26. When folded under the bottom panels 21–26, the edge of each rib 101–106 formed at the 180° fold of fold line 91–96 is designed to extend generally perpendicular to the adjacent side edge of the carton 10 between adjacent panels 11–16 as best shown in FIG. 17 to form bottom supporting edges for the carton 10.

Figure 17:
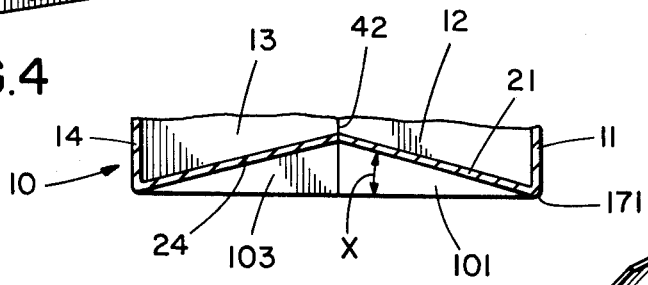
FIG. 17 is on the second sheet of drawings with FIGS. 4–7 and is a fragmentary sectional view of the bottom of the carton shown in FIG. 6 and is taken along line 17—17 of FIG. 6.

As shown in FIG. 17, the ribs 101 and 103 (and also ribs 102, and 104–106 not shown in FIG. 17) are generally triangular and bottom panels 21 and 24 (and also bottom panels 22, 23, 25 and 26 not shown in FIG. 17) incline upwardly at an angle X from the bottom edges of the carton, e.g., edges 171 and 174, toward the bottom center of the carton 10. The angle X can be any angle above 0° and up to approximately 90°. A feasable range is 10° to 80° and the most workable angle appears to be between 20° and 35°, e.g., 30°.

With a bottom 20 constructed and folded into place in the manner just described, the carton 10 is provided with a bottom having significant weight supporting capacity. The load bearing characteristic of the bottom 20 is provided by the inter-connecting of the bottom panels by the webs 81-86, by the reinforcing ribs 101-106 formed by the folding of the webs 81-86 and most importantly by the bearing and locking engagement between adjacent abuting side edges 71, 62; 72, 63; 73, 64; 74, 65; 75, 66; 76, 61 of bottom panels 21-26 when a load is placed thereon and urges the bottom panels 21–26 downwardly. The webs 81–86, of course, prevent the bottom panels from being vertically displaced from one another.

Figure 4:
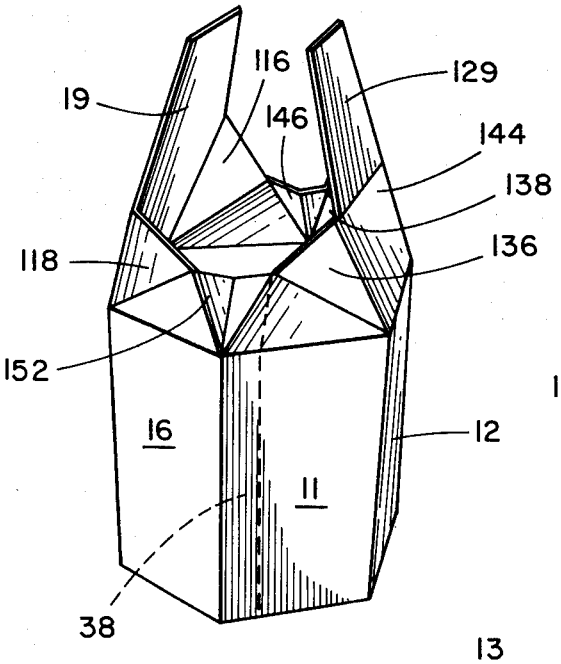
FIG. 4 is an elevational perspective view of the blank folded into the carton but with the top end closure assembly only partially folded.
Figure 5:
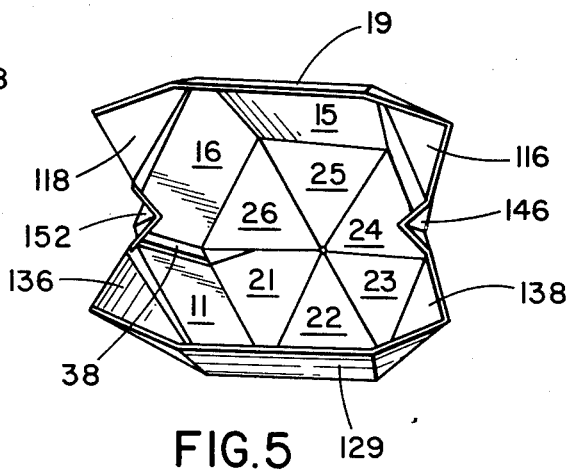
FIG. 5 is a top perspective view of the carton shown in FIG. 4 and shows the interior bottom of the carton.
Figure 7:
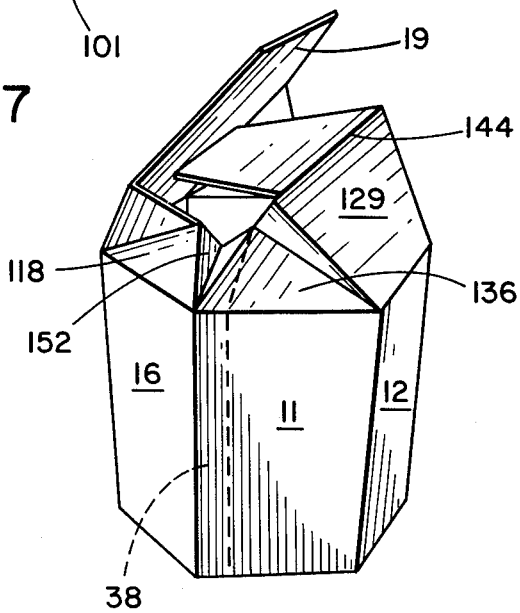
FIG. 7 is an elevational perspective view of the carton shown in FIG. 4 but with the top closure assembly folded further toward the closed position thereof.
Figure 8:
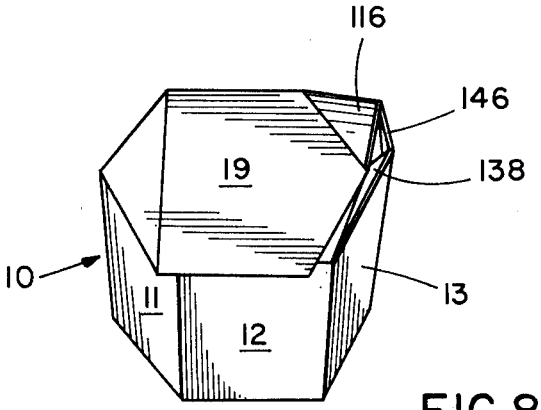
FIG. 8 is on the fourth sheet of drawings with FIGS. 13–16 and is a top perspective view of the carton shown in FIGS. 1 and 7 but with portions of the top end closure assembly folded outwardly of the carton to form a pour spout.

Once the carton is filled with goods the top closure assembly 18 can be closed by folding flap 129 under flap 19. This is done by folding foldable structures 116, 118, 136 and 138 and webs 146 and 152 inwardly as shown in FIGS. 4 and 7. The top end closure assembly 18 is only one of several end closures that can be utilized with the carton 10. However, the closure assembly 18 has the advantage that two of the foldable structures 116 and 138 and the interconnecting web 136 can be folded outwardly to form a pour spout as shown in FIG. 8 to facilitate pouring of a fluid material from the carton 10.

Figure 9:
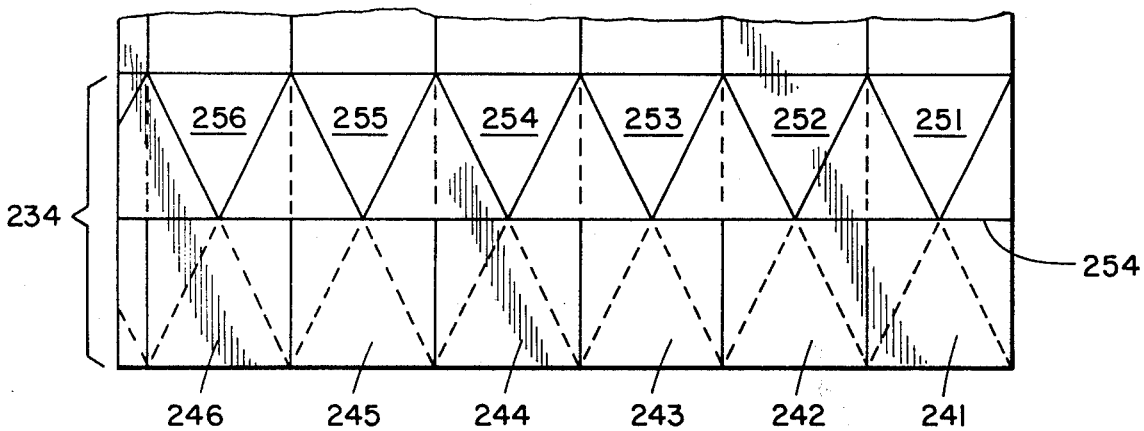
FIG. 9 is a plan view of a blank portion which is folded over to form a double-walled bottom for a carton constructed in accordance with the teachings the present invention.

The six sided carton 10 described above can be modified in several ways. For example, the carton blank from which the carton is formed, can have a modified bottom portion 234 as shown in FIG. 9. This bottom portion 234 has a plurality of panels 241–246 which are hingedly connected at a fold line 248 to a plurality of panels 251–256 containing triangular bottom panels and interconnecting webs identical to the bottom panels 21–26 and webs 81–86 and 88 as shown in FIG. 2. The panels 241–246 are separated by a plurality of vertical, parallel spaced fold lines. Each panel 241–246 has a pair of angular perforated fold lines.

With the construction just described, the panels 241–246 can be folded at fold line 248 onto panels 251–256 and then the overlapping panels 241, 251; 242, 252; etc., can be folded into a double ply or double walled bottom substantially identical to the carton bottom 20 shown in FIG. 6.

Figure 16:
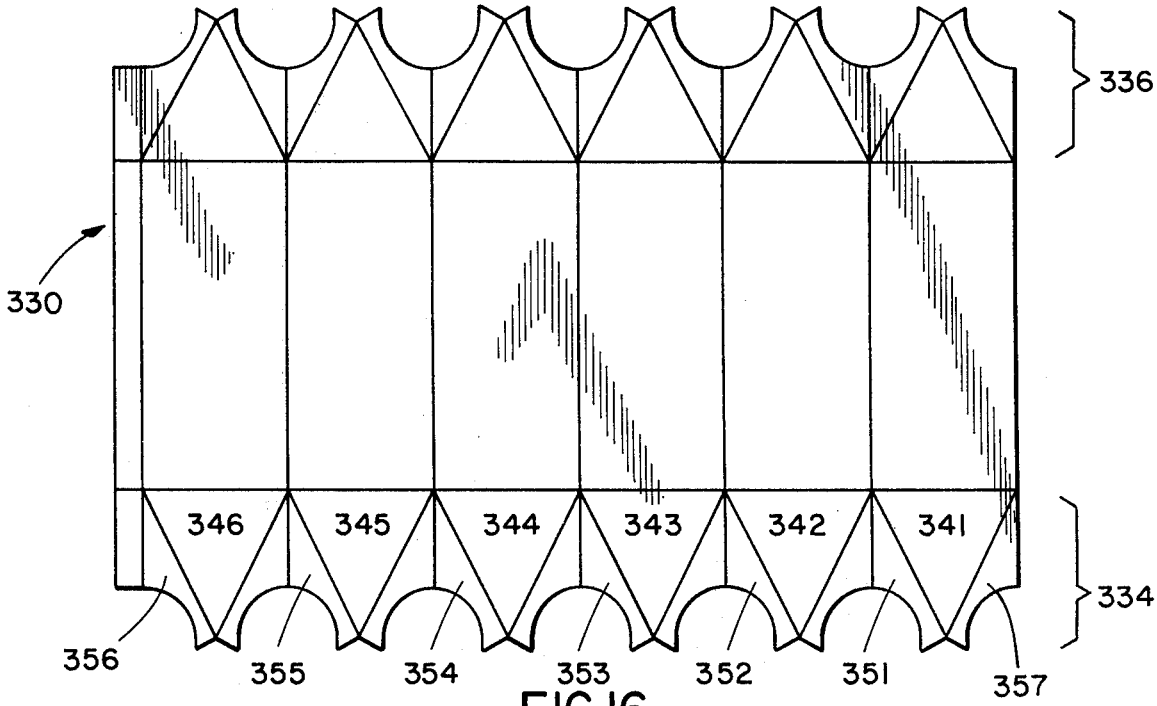
FIG. 16 is a plan view of a blank for a six sided carton which is similar to the carton shown in FIG. 1 but which has a top closure assembly identical to the construction of the carton bottom and has reinforcing ribs which are folded inside the carton at the top and bottom thereof to form cushions for goods packaged therein.

Another modification of a six sided carton blank is shown in FIG. 16 and is generally identified by the reference numeral 330. The blank 330 has a bottom portion 334 and a top portion 336 identical to the bottom portion 334, such that a carton formed from the blank 330 will have identical top and bottom closure assemblies.

Also the bottom portion 334 (and the substantially identical or mirror image top portion 336) has a plurality of bottom panels 241–246 interconnected by webs 351–355 and web end portions 356 and 357. The webs 351–355 and the web formed from web portions 356 and 357 have an irregular free edge. More specifically, the free edge of each web 351–355 extends angularly downwardly and then inwardly in the form of a semicircle. When the carton blank 330 is folded into a carton the webs 351–355 (and similar webs of the top portion 336) are folded into reinforcing ribs inside the carton. Also, the reinforcing ribs thus formed cooperate to form a cup shaped cushion within the carton which cushion is particularly suited for supporting a spherical product such as a globe.

In still another modification and as best indicated by the parallel spaced, horizontal dashed lines dividing the blank 30 shown in FIG. 2 into upper and lower sections, the carton blank 30 could be formed from two separate blank sections with one section, such as the upper blank section, being somewhat wider than the lower blank section to permit telescoping of the carton portion formed from the upper blank section over the carton portion formed from the lower blank section.

Still further, instead of the top closure assembly 18, the carton 10 could have a top closure identical to bottom 20.

Figure 10:
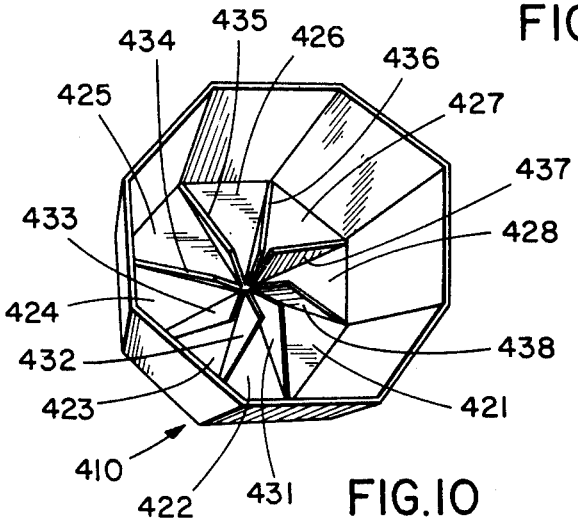
FIG. 10 is a top perspective view of an open top, eight sided carton having reinforcing ribs folded inside the carton above the bottom.
Figure 11:
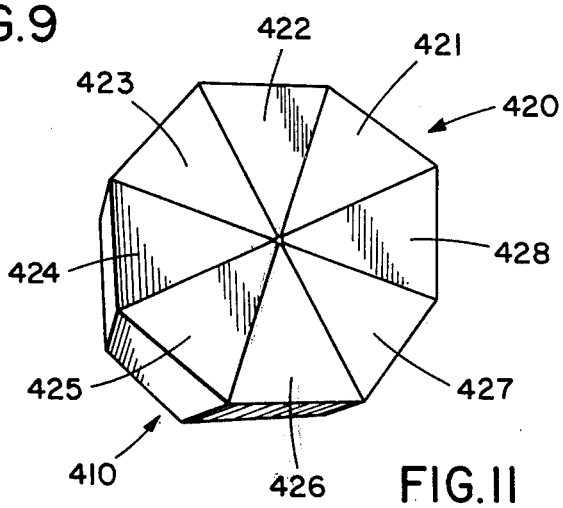
FIG. 11 is a bottom perspective view of the carton shown in FIG. 10.

Other embodiments of polygonal cartons constructed in accordance with the teachings of the present invention are shown in FIGS. 10–15. More specifically an open top, eight sided carton is shown in FIGS. 10 and 11 and is generally identified by the reference numeral 410. In this embodiment the carton 410 has a carton bottom 420 (FIG. 11) consisting of triangular bottom panels 421–428 interconnected by webs which are folded into reinforcing ribs 431–438 inside the carton 410. As shown in FIG. 10 these ribs 431–438 are disposed above the bottom panels 421–428 and are folded over onto the bottom panels 421–428 when goods (such as a fluid) are placed inside the carton 410.

The carton 410 is particularly adapted for use in place of a bushel-basket. In other words it is particularly suited for receiving and storing fruit such as apples, pears, oranges, etc.

Figure 12:
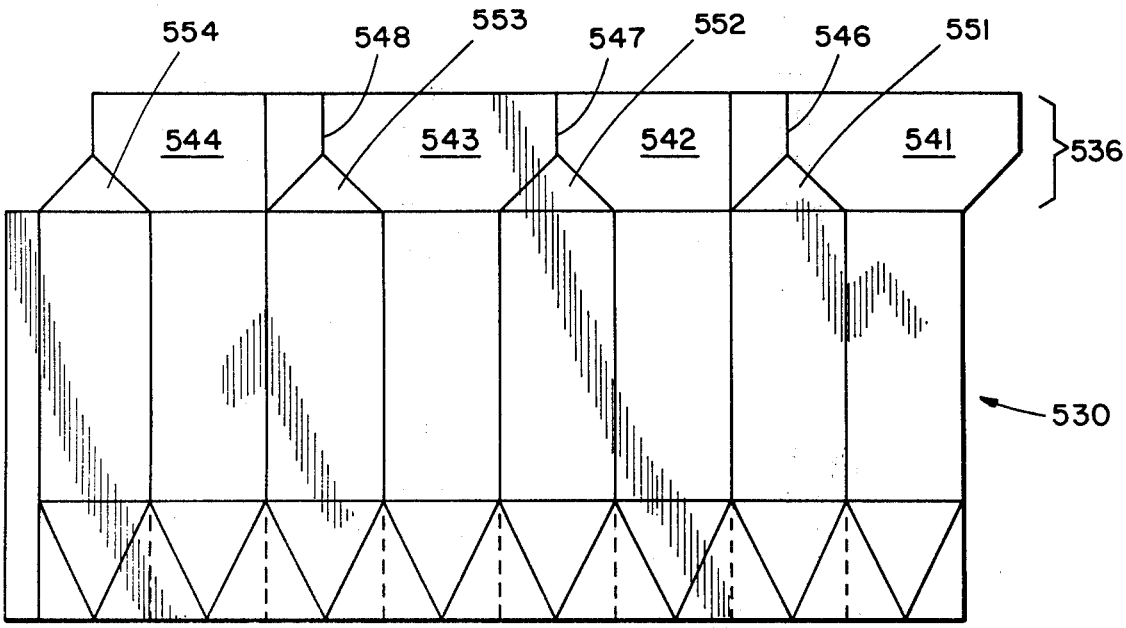
FIG. 12 is a plan view of a blank from which an eight sided carton with a top closure assembly can be formed.

In FIG. 12 there is shown a blank 530 for an eight sided carton having a top closure assembly 536. The top closure assembly 536 includes four flaps 541–544 separated by Y-shaped cuts 546–548 and four triangular panels 551–554 which are folded under the flaps 541–544.

Figure 13:
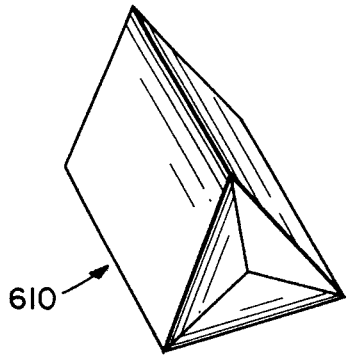
FIG. 13 is a bottom perspective view of a three sided carton constructed in accordance with the teachings of the present invention.
Figure 14:
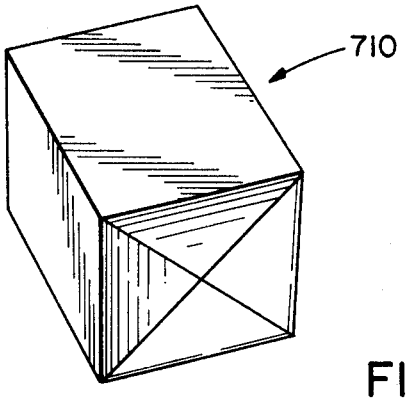
FIG. 14 is a bottom perspective view of a four sided carton constructed in accordance with the teachings of the present invention.
Figure 15:
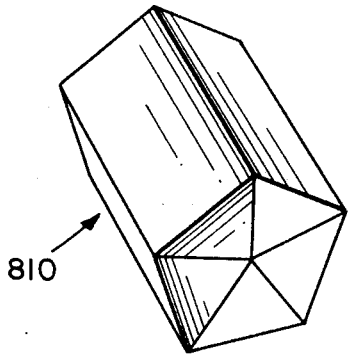
FIG. 15 is a bottom perspective view of a five sided carton constructed in accordance with the teachings of the present invention.

In FIGS. 13, 14 and 15 are shown respectively a three sided carton 610, a four sided carton 710, and a five sided carton 810. Each of the cartons 610, 710, 810 is shown with triangular bottom panels and with interconnecting reinforcing ribs hidden from view within the respective cartons.

It is to be understood that the reinforcing ribs for any carton constructed in accordance with the teachings of the present invention, such as the cartons illustrated in the Figures can be formed beneath or above the bottom wall panels of the carton. Also it is to be understood that the bottom wall panels of any polygonal carton constructed in accordance with the teachings of the present invention will incline upwardly from the bottom edges of the side panels toward the central axis of the carton to provide the carton thus formed with significant weight supporting capacity.

From the foregoing description it will be apparent that polygonal cartons constructed in accordance with the teachings of the present invention provide a number of advantages over existing cartons, some of which advantages have been described above and others of which are inherent in the cartons. Also it will be apparent that obvious modifications and variations can be made to such cartons without departing from the spirit or scope of the invention. Accordingly the scope of the invention is only to be limited as necessitated by the accompanying claims.

I claim:

1. A polygonal carton having a plurality of side panels and a strong weight supporting bottom formed by a plurality of generally triangular bottom panels equal in number to said side panels and a plurality of interconnecting webs, each web extending between a pair of adjacent bottom panels, each said bottom panel being hingedly connected to one of said side panels, being inclined upwardly from the bottom edge of the side panel to which it is connected so as to form an acute angle therewith, having two side edges which abut adjacent side edges of adjacent bottom panels and having said webs on either side thereof hingedly connecting said bottom panel to an adjacent bottom panel, whereby a load which is placed on said bottom and which urges said bottom panels downwardly will be supported by the locking and bearing engagement between said abuting edges of said bottom panels and by said interconnecting webs.

2. The carton according to claim 1 wherein said bottom panels are at least three in number.

3. The carton according to claim 1 wherein said carton is of the class consisting of four, six, eight, ten and twelve sided cartons.

4. The carton according to claim 1 wherein each said bottom panel forms an angle of between approximately 10° and 80° with the adjacent side panel.

5. The carton according to claim 1 wherein each said web has a fold line therein which divides said web into two rib sections and which is folded approximately 180° at said fold line to form a double ply reinforcing rib.

6. The carton according to claim 5 wherein each said reinforcing rib extends from one of the bottom corners of said carton toward the center of said carton.

7. The carton according to claim 5 wherein said reinforcing ribs are situated beneath said bottom panel and are hingedly connected to adjacent pairs of said bottom panels.

8. The carton according to claim 7 wherein said reinforcing ribs are generally triangular and form a star formation, each rib extending from a bottom corner to the center of said bottom and being disposed at a generally right angle to the adjacent bottom panel.

9. The carton according to claim 7 wherein the edge of each said rib formed at said 180° fold in each web extends generally perpendicular to the side edges of said carton to form bottom edges of said carton which will contact a supporting surface on which said carton is placed.

10. The carton according to claim 5 wherein said rib sections of each reinforcing rib are secured together by an adhesive.

11. The carton according to claim 1 being formed from a unitary blank of foldable material having a plurality of hingedly connected rectangular panels forming said side panels, one panel having a free side edge and another panel having a flap along a side edge thereof, said flap being secured to the margin adjacent said free side edge of said one panel.

12. The carton according to claim 1 being constructed from a unitary blank of double faced corrugated paperboard.

13. A unitary carton blank capable of being folded into a carton having a strong weight supporting bottom, set blank being made of stiff but foldable material and including a plurality of parallel spaced score lines dividing said blank into a plurality of generally rectangular side forming panels and a continuous, generally rectangular, webbing which extends along one side of said blank and which is perpendicular to said score lines, said webbing having therein a plurality of generally triangular bottom-forming panels equal in number to said rectangular panels, each triangular panel being hingedly connected to one of said rectangular panels, a plurality of rib-forming webs, each web extending between and hingedly interconnecting an adjacent pair of bottom panels, and two web portions one on each side of said blank, said bottom panels, webs, and web portions being configured and dimensioned in such a manner that when, said blank is folded into a carton, adjacent bottom panels abut each other and each web therebetween folds into a reinforcing rib hingedly connected to and between each pair of adjacent bottom panels.

14. The blank according to claim 13 wherein each web is generally triangular.

15. The blank according to claim 13 wherein each web has a fold line therein bisecting the angle between adjacent triangular panels and forming a continuation of one of said score lines.

16. The blank according to claim 15 wherein said fold line is a perforated line.

17. The blank according to claim 13 including a strip of adhesive extending along and adjacent a bottom edge of said blank and across said webs.

18. The blank according to claim 13 including a sealing flap along one side thereof hingedly connected to said first rectangular panel.

19. The blank according to claim 13 being made of double faced corrugated paperboard.

20. The carton according to claim 10 wherein said adhesive is defined by a double faced adhesive strip which, prior to folding of the blank, is situated along one edge of the blank, across each web, and adjacent the free edge of each rib section and, when the blank is folded, the adhesive on each web is folded over onto itself.

* * * * *